US006297439B1

(12) United States Patent
Browne

(10) Patent No.: US 6,297,439 B1
(45) Date of Patent: Oct. 2, 2001

(54) SYSTEM AND METHOD FOR AUTOMATIC MUSIC GENERATION USING A NEURAL NETWORK ARCHITECTURE

(75) Inventor: Cameron Bolitho Browne, Burleigh Heads (AU)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/379,611

(22) Filed: Aug. 24, 1999

(30) Foreign Application Priority Data

Aug. 26, 1998 (AU) ..... PP5478

(51) Int. Cl.[7] ..... G10H 1/42

(52) U.S. Cl. ..... 84/635; 84/667; 84/DIG. 10; 84/DIG. 12

(58) Field of Search ..... 84/611, 612, 635, 84/636, 651, 652, 667, 668, DIG. 10, DIG. 12

(56) References Cited

U.S. PATENT DOCUMENTS 4,345,501 * 8/1982 Nakada et al. ..... 84/DIG. 10
5,635,659 * 6/1997 Miyamoto ..... 84/635
5,920,025 * 7/1999 Itoh et al. ..... 84/611

FOREIGN PATENT DOCUMENTS

WO 96/12221 4/1996 (WO) .

* cited by examiner

*Primary Examiner*—Stanley J. Witkowski
(74) *Attorney, Agent, or Firm*—Fitzpatrick, Cella, Harper & Scinto

(57) ABSTRACT

A system and method are disclosed for automatically generating music on the basis of an initial sequence of input notes, and in particular to such a system and method utilizing a recursive artificial neural network (RANN) architecture. The aforementioned system includes a score interpreter (2) interpreting an initial input sequence, a rhythm production RANN (4) for generating a subsequent note duration, a note generation RANN (6) for generating a subsequent note, and feedback means for feeding the pitch and duration of the subsequent note back to the rhythm generation (4) and note generation (6) RANNs, the subsequent note thereby becoming the current note for a following iteration.

22 Claims, 5 Drawing Sheets

SYSTEM AND METHOD FOR AUTOMATIC MUSIC GENERATION USING A NEURAL NETWORK ARCHITECTURE

FIELD OF THE INVENTION

The present invention relates to a system and method for automatically generating music on the basis of an initial sequence of input notes, and in particular to such a system and method utilising a recursive artificial neural network architecture.

The invention has been developed primarily to learn and emulate music of a given style or by a specific composer, and will be described hereinafter with reference to this application. However, it will be appreciated that the invention is not limited to this field of use.

BACKGROUND

Automatic generation of music is a relatively complex task, due to the difficulties associated with defining subjectively aesthetically pleasing factors in a way that enables a computer or the like to generate music. A simpler task is the production of chordal rhythmic accompaniment in real time, which has become a standard feature of many synthesizers. In its simplest form, such accompaniment involves interpreting chords or notes input by a user and generating a suitable accompaniment in the form of rhythmic chords or arpeggios.

An advanced system known as "EMI" uses augmented transition networks (ATMs), and is capable of producing relatively high quality works of music in the style of famous composers. EMI is based on a knowledge base of musical sequences known to be representative of a composer's work, which arc subsequently assembled using a musical grammar under the direction of a skilled human user. Unfortunately, the subjective quality of music generated by the EMI system is variable, and the system requires a great deal of skill on the part of the user to extract its full potential.

SUMMARY OF THE INVENTION

It is an object of the present invention to provide an improved automatic music generation system for generating music which is evocative of a given style or composer.

Accordingly, in a first aspect, the present invention provides a system for automatically generating music on the basis of an initial note sequence input, the system including:

a score interpreter for interpreting each note in the initial input sequence, thereby to generate current note pitch data, current note duration data and current note musical context data;

a rhythm production part for generating a subsequent note duration output on the basis of the current note duration data, the current musical context data and note duration information stored in state units associated with the rhythm production part;

a note generation part for generating a subsequent note on the basis of the subsequent note duration output, the current note pitch data, the current note musical context data, the current note duration data, and duration and pitch information stored in state units associated with the note generation part; and feedback means for feeding the pitch and duration of the subsequent note back to the rhythm generation and note generation parts, the subsequent note thereby becoming the current note for a following iteration.

According to another aspect, the invention provides a method of automatically generating music on the basis of an initial note sequence input, the apparatus including:

interpreting each note in the initial input sequence, thereby to generate current note pitch data, current note duration data and current note musical context data;

generating a subsequent note duration output on the basis of the current note duration data using a rhythm production part;

storing the current musical context data and note duration information in one or more state units associated with the rhythm production part;

generating a subsequent note using a note generation part on the basis of the subsequent note duration output, the current note pitch data, the current note musical context data, the current note duration data, and duration and pitch information stored in state units associated with the note generation part; and feeding back the pitch and duration of the subsequent note back to the rhythm generation and note generation parts, the subsequent note thereby becoming the current note for a following iteration.

According to another aspect, the invention provides a computer program product including a computer readable medium having recorded thereon a computer program for automatically generating music on the basis of an initial note sequence input, the computer program comprising:

interpretation process steps arranged to interpret each note in the initial input sequence, thereby generating current note pitch data, current note duration data, and current note musical context data;

generating process steps arranged to generate a subsequent note duration output on the basis of the current note duration data using a rhythm production part;

storing process steps arranged to store the current musical context data and note duration information in one or more state units associated with the rhythm production part;

generation process steps arranged to generate a subsequent note using a note generation part on the basis of the subsequent note duration output, the current note pitch data, the current note musical context data, the current note duration data, and duration and pitch information stored in state units associated with the note generation part; and feedback process steps arranged to feed the pitch and duration of the subsequent note back to the rhythm generation and note generation parts, the subsequent note thereby becoming the current note for a following iteration.

BRIEF DESCRIPTION OF THE DRAWINGS

The invention will now be described, by way of example only, with reference to the accompanying drawings, in which.

DETAILED DESCRIPTION OF THE PREFERRED EMBODIMENTS

Figure 1:
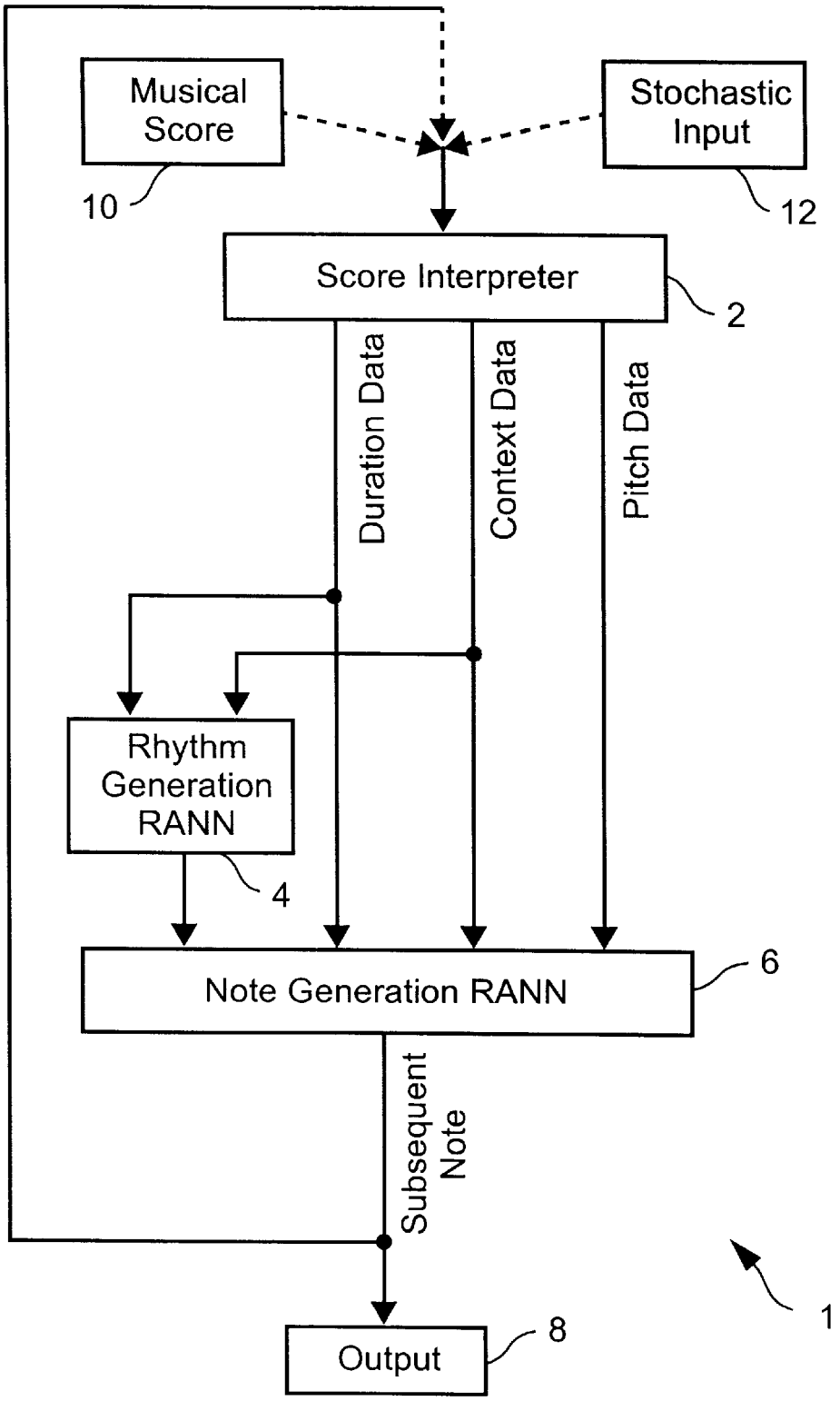
FIG. 1 is a schematic diagram of a first embodiment of a system for automatically generating music.

Referring to FIG. 1, there is shown a schematic of a system 1 for automatically generating music on the basis of an initial note sequence input. The system 1 includes a score interpreter 2, which generates duration data, context data and pitch data from an input musical score 10. The duration and context data are fed to a rhythm generation recurrent artificial neural network ("RANN") 4. The duration data, context data and pitch data, along with the output of the rhythm generation RANN 4, are fed to a note generation RANN 6. The output 8 of the note generation RANN 6 is played directly via a suitable synthesiser (not shown), or stored in either a proprietary notation or a standard music storage format such as MIDI or the like.

Figure 2:
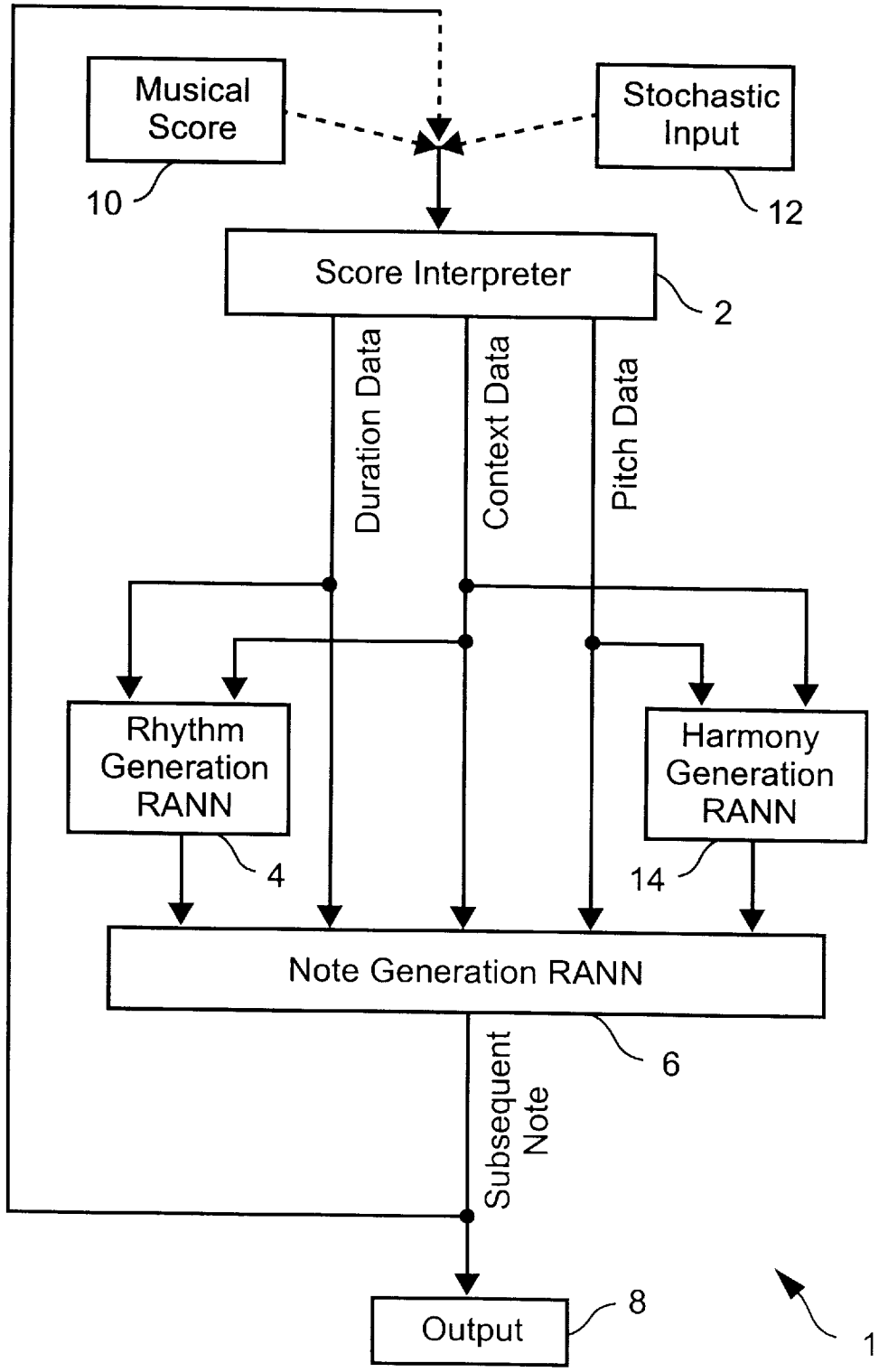
FIG. 2 is a schematic diagram showing an alternative embodiment of a system for automatically generating music.

A modified version of the system of FIG. 1 is shown in FIG. 2. In this case, an additional harmony generation RANN 14 is added. The harmony generation RANN 14 takes pitch data and context data from the score interpreter 2 and provides a harmony output to the note generation RANN 6. It will be appreciated that the remainder of the system 1 shown in FIG. 2 corresponds with that shown in FIG. 1, with like features being indicated with like reference numerals.

Figure 3:
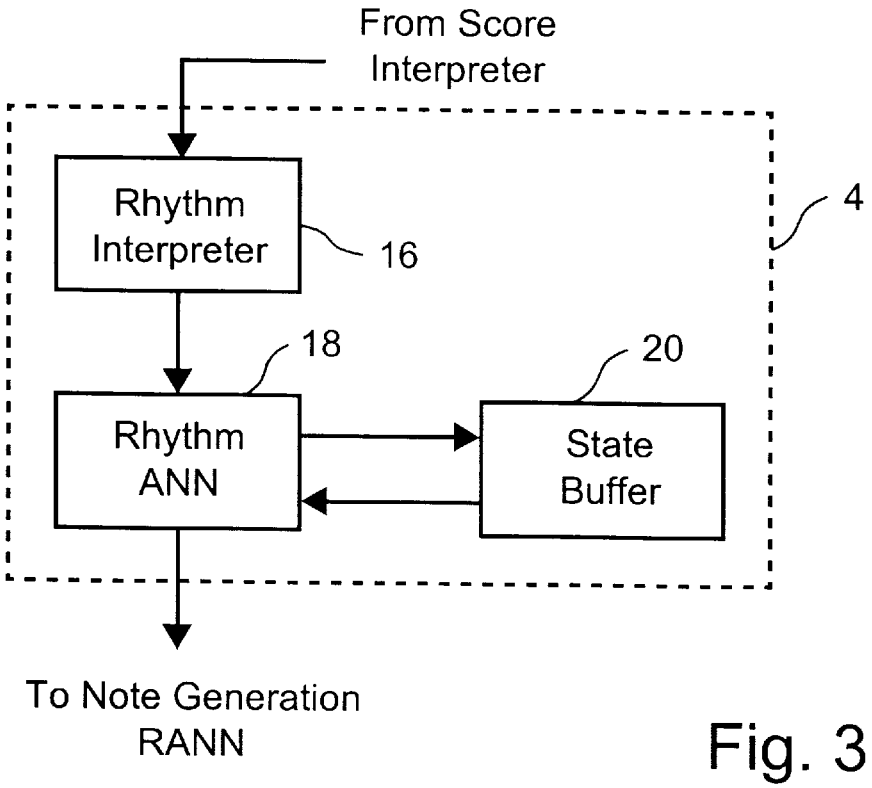
FIG. 3 shows a detailed schematic diagram of a preferred form of the rhythm generation RANN used in the systems shown in FIGS. 1 and 2.

Turning to FIG. 3, there is shown a preferred embodiment of the rhythm generation RANN 4. A rhythm interpreter 16 accepts duration data and context data from the score interpreter 2. After this data is interpreted (as described in more detail below) the result is fed to a rhythm artificial neural network ("ANN") 18. Due to its recurrent architecture, the rhythm ANN 18 includes a multiple level state buffer 20 for storing past outputs of the rhythm ANN 18. The output of the rhythm ANN is fed to the note generation RANN 6.

Figure 4:
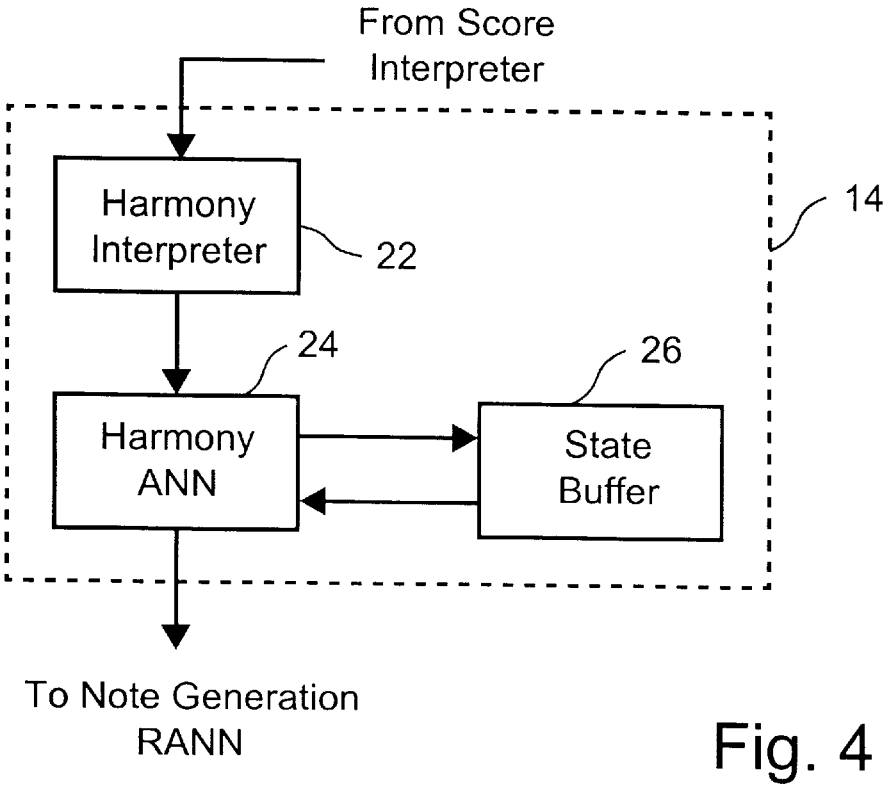
FIG. 4 shows a detailed schematic diagram of a preferred form of the harmony generation RANN shown in FIG. 2.

FIG. 4 shows a preferred embodiment of the harmony generation RANN 14. A harmony interpreter 22 accepts context data and pitch data from the score interpreter 2, processes it and passes the result to a harmony ANN 24. As with the rhythm ANN 18, there is provided a multiple level state buffer 26 for storing past outputs of the harmony ANN 24. The output of the harmony ANN 24 is fed to the note generation RANN 6.

The note generation RANN 6 similarly has a multiple level state buffer (not shown) associated with it to store previous outputs thereof.

The function of the systems shown in FIGS. 1 and 2, and the individual components thereof, will now be described in greater detail.

In both embodiments of the system, there are two main states or phases in which the system operates.

Learning Phase

The first phase of the system is a learning phase. During this phase, music data in the form of one or more musical scores is fed to the score interpreter 2, where duration data, context data and pitch data are extracted. In the usual application of the system, the musical score will be presented in the form of a plurality of simultaneous distinct voices. Whilst the voices are considered individually by the score interpreter, they arc also interpreted as a whole in order to extract information such as the chordal structure, cadences, and other musical context information only ascertainable by considering all or at least many of the pitches of the simultaneous distinct voices.

The music can be provided in the form of a preprocessed data stream such as a MIDI or MIDI-like representation. Alternatively, the well-defined structure of most mechanically reproduced musical scores means that sheet music can be scanned and automatically interpreted. The stave can readily be identified and used to provide a reference frame for the detection of the musical information it contains. Initially, the clef, time signature and key signature will be recognised, and this information fed to the score interpreter 2. The notes themselves can be recognised by the elliptical shape of the note head, and provide information such as note pitch (position on stave lines) and note duration (e.g. unfilled for minims or semibreves, filled for crotchets, quavers, and semiquavers). Note stems are vertical lines projecting from the note heads, and can provide information such as note duration, in conjunction with whether the note head is filled, and phrasing in relation to triplets and the like.

Other musical symbols to be identified, such as dotted notes and accidentals, usually occur in relatively well established positions with respect to note heads. Additional symbols such as slurs, accents, loudness indications, crescendos and decrescendos are harder to identify, and can in many instances be ignored. However, in some embodiments, it can be desirable to include this information.

Once the note sequences from an input musical score are extracted, the following information can be obtained:

- Key: readily deduced from the key signature (trivial);
- Scale: major, minor (natural, harmonic or melodic), diminished, augmented and others, can be deduced from the key signature as well as from interpreting patterns within local groups of notes or bars (reasonably straightforward);
- Mode: ionian, dorian, phrygian, lydian, mixolydian, aeolian or locrian (reasonably straightforward);
- Chord progression: the sequence in which chords appear (reasonably straightforward);
- Composition structure: a piece can be broken into phrases or themes that may be repeated with or without variation, such as ABACA (difficult); and
- Embellishments and variations: once a phrase is identified, embellishments and variations of the phrase can exist, including dynamic changes in tempo and volume, grace notes, melodic inversions and other more subtle changes (extremely difficult).

As much of this information as is deemed necessary in a particular case is determined from the note sequences extracted from the musical score. In some cases, the musical score itself will be presented in a format (such as MIDI notation) such that extraction of the requisite elements will be a relatively simple task. In other cases, the score interpreter will need to undertake the entire interpretation process from character and note recognition from a printed score through to extraction of some or all of the data mentioned above.

The data extracted can be categorised as duration data, context data or pitch data. The duration data is associated with the lengths of the notes and rests in the musical score, and is an important component of rhythm.

In the preferred embodiment, bars of a score are divided into discrete equispaced time units, the number of which are determined from:

$$units=6*2^n$$

where n indicates the duration of the shortest note to be represented (e.g. semibreve: n=0, minimum: n=1, crotchet: n=2, quaver: n=3, semiquaver: n=4, demi semiquaver: n=5, etc). For example, if the shortest note is a semiquaver then each bar is defined as having a total of $6*2^4=96$ time units. In 4/4 time, a crotchet then occupies a total of $96/2^2=24$ time units, and a semiquaver (the lower limit) occupies $96/2^4=6$ time units.

The constant factor '6' in the above equation was selected for a number of reasons. The first is that it ensures the total number of time units per bar will be divisible by two and three, which are common time signature numerators. Furthermore, triplets can be represented in non triple-time signatures. Also, dotted notes occupy 3/2 times as many time units as their undotted equivalents. Each note must fall on a discrete time unit, and so the minimum note duration should give an integer value when multiplied by 3/2.

The lowest possible resolution is used to minimise the number of network inputs for subsequent processing. A separate input for each time unit would result in an excessively large input space, and so it is strongly desirable to encode time information more efficiently. Note duration can be encoded by defining a discrete note length (the number of time units occupied by the note), a Boolean value indicating whether the note is dotted, and a Boolean value indicating whether the note is part of a triplet (non-triple time signatures only). Bar position is encoded by identifying context information, such as whether the note is on or off the beat, whether it falls on the first or last beat of a bar, and whether it is the final note in the bar.

Under this arrangement, each note's position in the bar can discretely be encoded. This is important because note production is often dependent on particular note positions within the bar. For example, "strong" notes usually appear on the beat, whilst leading notes indicating a key modulation often appear towards the end of the bar. Relative bar and phrase positions describe the context of a note.

During the learning phase, each voice from the musical score is presented to the system via the score interpreter 2, along with the various other available information such as chord, scale/mode, context, and any other desired information. By using duration data and context data, the rhythm generation RANN 4, during the learning phase, adjusts internal weights such that rhythmic patterns within the input scores are impressed upon the rhythm generation RANN 4 as a whole. As a plurality of scores by a composer or from a particular style or period of music are input, the rhythm generation RANN 4 is able to generalise rhythmic input, such that, for a sequence of stochastic input notes 12 input to the score interpreter during the music generation phase, the rhythm generation RANN can generate the most likely duration for a subsequent note. It should be noted that the rhythm interpreter 16 shown in the preferred embodiment of the rhythm generation RANN 4 can, in the preferred embodiment, be bypassed during the learning phase.

The note generation RANN 6 works in a similar fashion to the rhythm generation RANN 4, although it has a greater number of inputs. Specifically, as well as the duration data and context data provided to the rhythm generation RANN 4, the note generation RANN 6 receives the most probable duration from the rhythm generation RANN 4, as well as pitch data from the score interpreter 2. Using all of this information, the note generation RANN 6, during the learning phase, adjusts internal weights to impress likely chord progressions, note progressions or a combination of the two.

The harmony generation RANN 14, as shown in FIG. 2, is trained in a similar fashion to the note and rhythm generation RANNs 4 and 6. However, the harmony generation RANN 14 adjusts its internal weights in response to the chord progression characteristics of the musical score or scores presented to it during the learning phase. Again, the harmony interpreter can be bypassed during the learning phase, at least in the preferred embodiment.

Figure 5:
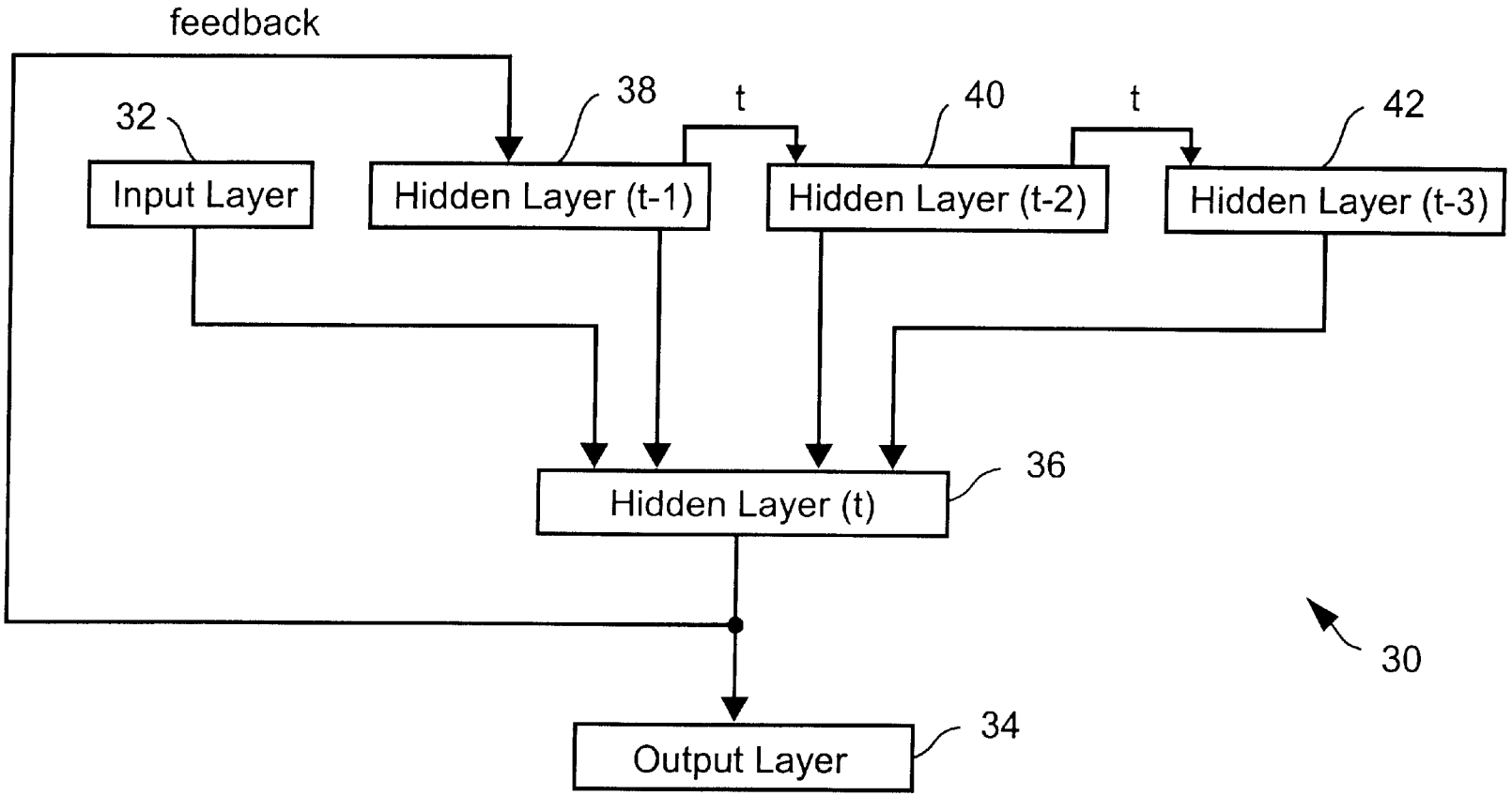
FIG. 5 shows a schematic diagram of an example of a generic recurrent artificial neural network.

The actual architecture associated with each of the artificial neural network portions of the RANNs can vary depending upon such factors as the complexity of the music, the number of voices to be generated or interpreted, and the variations in style between the scores intended to be presented to the system during the learning phase. It will be appreciated that the architecture illustrated is an example only, and that significantly different RANN architectures can be used. FIG. 5 shows an example of a generic recurrent artificial neural network 30. The recurrent artificial neural network 30 includes an input layer 32 for accepting an input vector, an output layer 34 for storing an output vector, and a hidden layer 36. At any given time (t), hidden layer 36 comprises a number of values. Previous values of the hidden layer 36 are stored in a buffer and used as additional input vectors along with that of the main input vector. In the embodiment shown, three sets of previous hidden layer values for times (t−1), (t−2) and (t−3), designated 38, 40 and 42 respectively, are being used as additional input vectors to the recurrent artificial neural network 30.

In other embodiments, different numbers of hidden layers can be used, and different numbers and combinations of previous sets of hidden layer values used as additional input vectors. In yet other embodiments, the sets of previous output values can be used as additional input vectors, with or without previous sets of hidden layer values.

Figure 6:
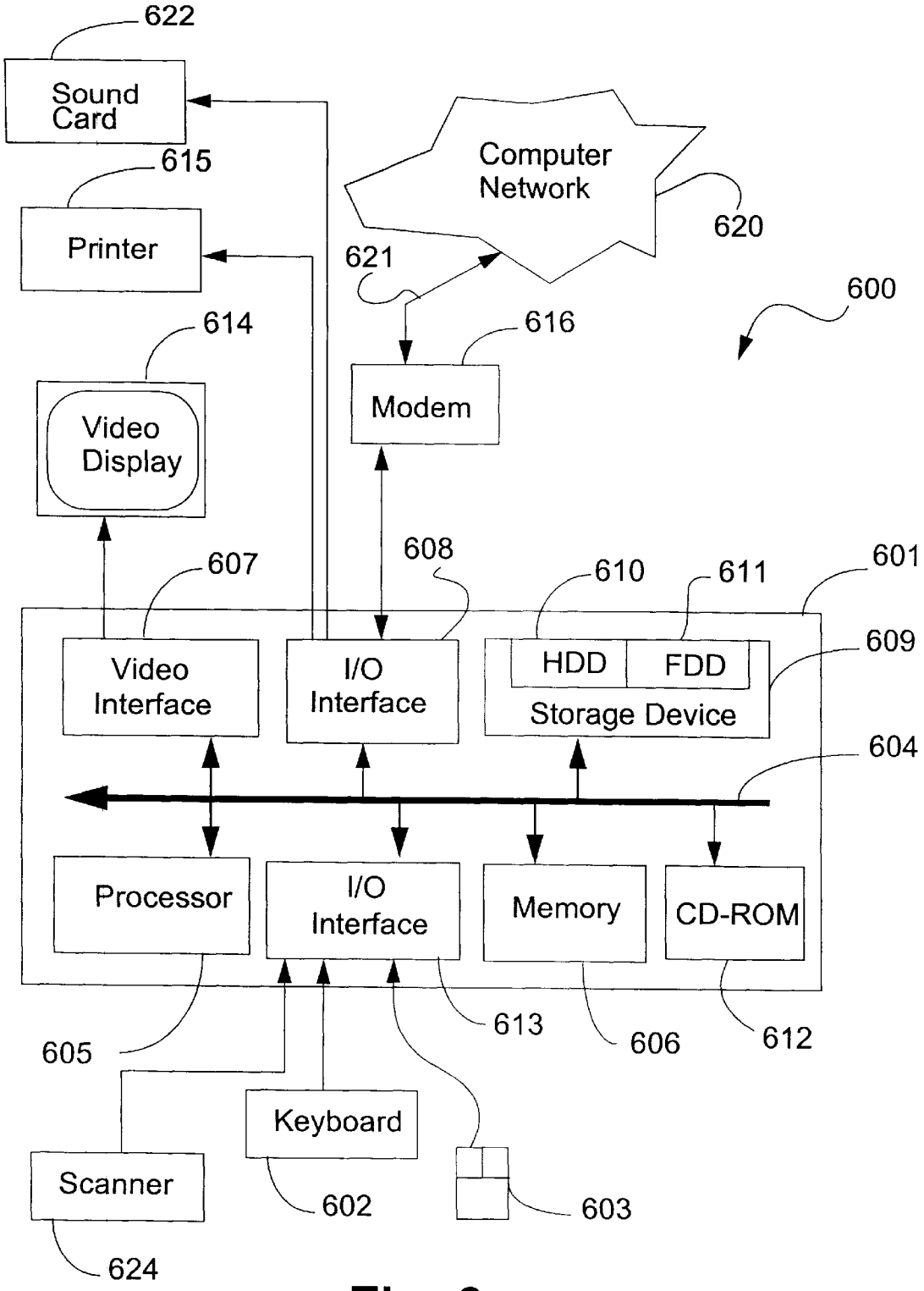
FIG. 6 is a schematic block diagram of a general purpose computer upon which the preferred embodiments of the present invention can be practiced.

The method of automatic music generation is preferably practiced using a conventional general-purpose computer system 600, such as that shown in FIG. 6 wherein the processes of automatic music generation may be implemented as software, such as an application program executing within the computer system 600. In particular, the steps of the method of automatic music generation are effected by instructions in the software that are carried out by the computer. The output of the system can then be fed to a suitable sound interface such as a PC sound card 622. Optionally, a scanner 624 is attached to the computer to scan musical scores for recognition prior to being fed to the score interpreter in a learning phase. The software may be divided into two separate parts; one part for carrying out the automatic music generation methods; and another part to manage the user interface between the latter and the user. The software may be stored in a computer readable medium, including the storage devices described below, for example. The software is loaded into the computer from the computer readable medium, and then executed by the computer. A computer readable medium having such software or computer program recorded on it is a computer program product. The use of the computer program product in the computer preferably effects an advantageous apparatus for automatic music generation in accordance with the embodiments of the invention.

The computer system 600 comprises a computer module 601, input devices such as a keyboard 602, scanner 624 and mouse 603, output devices including a printer 615, sound card 622 and a display device 614. A Modulator-Demodulator (Modem) transceiver device 616 is used by the computer module 601 for communicating to and from a communications network 620, for example connectable via a telephone line 621 or other functional medium. The modem 616 can be used to obtain access to the Internet, and other network systems, such as a Local Area Network (LAN) or a Wide Area Network (WAN).

The computer module 601 typically includes at least one processor unit 605, a memory unit 606, for example formed from semiconductor random access memory (RAM) and read only memory (ROM), input/output (I/O) interfaces including a video interface 607, and an I/O interface 613 for the keyboard 602 and mouse 603 and optionally a joystick (not illustrated), and an interface 608 for the modem 616. A storage device 609 is provided and typically includes a hard disk drive 610 and a floppy disk drive 611. A magnetic tape drive (not illustrated) may also be used. A CD-ROM drive 612 is typically provided as a non-volatile source of data. The components 605 to 613 of the computer module 601, typically communicate via an interconnected bus 604 and in a manner which results in a conventional mode of operation of the computer system 600 known to those in the relevant art. Examples of computers on which the embodiments can be practised include IBM-PC's and compatibles, Sun Sparc-stations or alike computer systems evolved therefrom.

Typically, the application program of the preferred embodiment is resident on the hard disk drive 610 and read and controlled in its execution by the processor 605. Intermediate storage of the program and any data fetched from the network 620 may be accomplished using the semiconductor memory 606, possibly in concert with the hard disk drive 610. In some instances, the application program may be supplied to the user encoded on a CD-ROM or floppy disk and read via the corresponding drive 612 or 611, or alternatively may be read by the user from the network 620 via the modem device 616. Still further, the software can also be loaded into the computer system 600 from other computer readable medium including magnetic tape, a ROM or integrated circuit, a magneto-optical disk, a radio or infra-red transmission channel between the computer module 601 and another device, a computer readable card such as a PCMCIA card, and the Internet and Intranets including email transmissions and information recorded on websites and the like. The foregoing is merely exemplary of relevant computer readable mediums. Other computer readable mediums may be practiced without departing from the scope and spirit of the invention.

The method of automatic music generation may alternatively be implemented in dedicated hardware such as one or more integrated circuits performing designed for neural net applications. Such dedicated hardware may include graphic processors, digital signal processors, or one or more microprocessors and associated memories.

Music Generation Phase

During this phase, the various state buffers associated with the RANNs are assigned stochastic values, and then a suitable sequence of, say, four notes is input to the system via the score interpreter 2. The input notes can be determined stochastically, or can be extracted from a known piece of music. The input notes are then broken down into pitch, duration and musical context data by the score interpreter 2 and supplied to the relevant RANNs.

Each of the RANNs uses its inputs and the contents of its state buffers to determine the most likely pitch and, where the harmony RANN 14 is implemented, the most likely harmony value for a subsequent note given the previous notes. The outputs of the rhythm generation RANN 4 (and the harmony generation RANN 14 where appropriate) are then fed to the note generation RANN 6, along with the duration, pitch and context data from the score interpreter 2. The note generation RANN 6 then determines the most likely pitch for the subsequent note and provides this as an output 8. Depending upon the implementation, the duration (and harmony) data can be provided as an output of the note generation RANN 6, but will more usually be provided directly from the respective rhythm and harmony RANNs 4 and 14. The output 8 is stored, reproduced as a score, or played directly via a musical synthesizer.

The output 8, including at least pitch and duration data, is also fed back to the score interpreter 2 to provide the next piece of recurrent information for the system. The procedure is repeated iteratively until the piece of music being generated by the system ends, as determined by the RANNs.

In addition to the pitch, duration and harmony probabilities generated by the various RANNs, noise can be added at one or more points in the system to reduce the chances of exact reproduction of previously learnt sequences. The noise can be introduced at the input of any of the components of the system 1, and in a preferred form, the degree of noise introduced is specified by a user. High amounts of noise will generate relatively original music, although in many cases this will result in a perceptive lowering of the aesthetic standard of the music as a whole, as well as a greater departure from the learned composer or style.

In a preferred form, additional parameters are provided to allow the various RANNs to take into account the particular instruments assigned to each voice. Correct instrument choice is important for accurate imitation of known styles or composers, since composers generally write to the strengths and weaknesses of the instruments in an ensemble. This aspect is particularly critical if the generated music is to be performed by actual musicians on the instruments nominated.

Certain instruments can be associated with certain musical styles and even given roles within those styles. For example, a double bass may be assigned to a bass line, a cello to harmony and a violin to a solo line in a three piece string ensemble composition. A knowledge base (not shown) can be provided linking the tonal characteristics of various instruments, including a harmonic analysis of sound complexity and such factors as envelope, which will enable the system to determine the most appropriate instrument for a generated voice. For example, instruments may be grouped into those having sounds of low complexity, such as flute or cello, or high complexity, such as symbols or distorted guitar. Also the various pitch ranges of instruments must be included to ensure that the music composed for a particular instruments, or the instrument assigned to a composed voice, is appropriate.

The preferred embodiment provides a means of automatically generating music which emulates a particular musical style or composer, with greater sophistication than systems currently available. For this reason, the present invention represents a commercially significant improvement over prior art automatic music generation systems.

Although the invention has been described with reference to a number of specific examples, it will be appreciated that the invention may be embodied in many other forms.

What is claimed is:

1. A system for automatically generating music on the basis of an initial note sequence input, the system including:

a score interpreter for interpreting each note in the initial input sequence, thereby to generate current note pitch data, current note duration data and current note musical context data;

a rhythm production part for generating a subsequent note duration output on the basis of the current note duration data, the current musical context data and note duration information stored in state units associated with the rhythm production part;

a note generation part for generating a subsequent note on the basis of the subsequent note duration output, the current note pitch data, the current note musical context data, the current note duration data, and duration and pitch information stored in state units associated with the note generation part; and feedback means for feeding the pitch and duration of the subsequent note back to the rhythm generation and note generation parts, the subsequent note thereby becoming the current note for a following iteration.

2. A system according to claim 1, wherein said rhythm production part comprises a rhythm production RANN and said note generation part comprises a note generation RANN, and further including a harmony generation RANN for generating a harmony output on the basis of the current note pitch data, the current musical context data, and harmony information stored in state units associated with the harmony generation RANN, wherein the note generation RANN generates the subsequent note on the basis of the harmony output.

3. A system according to claim 2, wherein the harmony generation RANN includes a harmony interpreter for preprocessing the current note pitch data and the current note musical context data to generate preprocessed harmony data for input to a main processing portion of the harmony generation RANN.

4. A system according to claim 2, wherein the state units associated with each of the RANNs stores results of a plurality of prior outputs from that RANN.

5. A system according to claim 2, wherein the rhythm generation RANN includes a rhythm interpreter for preprocessing the current note duration data and the current note musical context data to generate processed rhythm data for input to a main processing portion of the RANN.

6. A system according to claim 2, wherein during a learning phase each of the RANNs is trained by feeding the score of at least one piece of music through the score interpreter, internal weights associated with an ANN portion of each of the RANNs being adjusted in response to the input musical score.

7. A system according to claim 6, wherein the RANNs are trained by feeding the scores of a plurality of pieces of music through the score interpreter.

8. A system according to claim 7, wherein a majority of the plurality of pieces of music are by the same composer.

9. A system according to any one of claims 6 to 8, wherein the scores of the pieces of music are input to the score interpreter on a voice by voice basis.

10. A system according to claim 1, wherein the musical context data includes a general music knowledge database for use in conjunction with context data specific to the current note.

11. A system according to claim 1, wherein the musical context data includes a specific music knowledge database for storing information on specific scores input to the system during a learning phase.

12. A method of automatically generating music on the basis of an initial note sequence input, the method comprising steps of:

interpreting each note in the initial input sequence, thereby to generate current note pitch data, current note duration data and current note musical context data;

generating a subsequent note duration output on the basis of the current note duration data and the current note context data using a rhythm production part;

storing the current musical context data and note duration information in one or more state units associated with the rhythm production part;

generating a subsequent note using a note generation part on the basis of the subsequent note duration output, the current note pitch data, the current note musical context data, the current note duration data, and duration and pitch information stored in state units associated with the note generation part; and feeding back the pitch and duration of the subsequent note back to the rhythm generation and note generation parts, the subsequent note thereby becoming the current note for a following iteration.

13. A method according to claim 12, wherein said rhythm production part comprises a rhythm production RANN and said note generation part comprises a note generation RANN, and further including the step of generating a harmony output using a harmony generation RANN, on the basis of the current note pitch data, the current musical context data, and harmony information stored in state units associated with the harmony generation RANN; and generating the subsequent note using the note generation RANN, on the basis of the harmony output.

14. A method according to claim 13, further including the steps of:

preprocessing the current note pitch data and the current note musical context data using a harmony interpreter associated with the harmony generation RANN, thereby to generate preprocessed harmony data;

feeding the preprocessed harmony data into a main processing portion of the harmony generation RANN.

15. A method according to claim 13, including the step of storing results of a plurality of prior outputs from each respective RANN within the state units associated therewith.

16. A computer program product including a computer readable medium having recorded thereon a computer program for automatically generating music on the basis of an initial note sequence input, the computer program comprising:

interpretation process steps arranged to interpret each note in the initial input sequence, thereby generating current note pitch data, current note duration data, and current note musical context data;

generating process steps arranged to generate a subsequent note duration output on the basis of the current note duration data and the current note context data using a rhythm production part;

storing process steps arranged to store the current musical context data and note duration information in one or more state units associated with the rhythm production part;

generation process steps arranged to generate a subsequent note using a note generation part on the basis of the subsequent note duration output, the current note pitch data, the current note musical context data, the current note duration data, and duration and pitch information stored in state units associated with the note generation part; and feedback process steps arranged to feed the pitch and duration of the subsequent note back to the rhythm generation and note generation parts, the subsequent note thereby becoming the current note for a following iteration.

17. A computer program product according to claim 16, wherein said rhythm production part comprises a rhythm production RANN and said note generation part comprises a note generation RANN, and wherein the computer readable medium has recorded thereon a computer program further comprising:

generation process steps arranged to generate a harmony output using a harmony generation RANN, on the basis of the current note pitch data, the current musical context data, and harmony information stored in state units associated with the harmony generation RANN; and generation process steps arranged to generate the subsequent note using the note generation RANN, on the basis of the harmony output.

18. A computer program product according to claim 17 wherein the computer readable medium has recorded thereon a computer program further comprising:

preprocessing process steps arranged to preprocess the current note pitch data and the current note musical context data using a harmony interpreter associated with the harmony generation RANN, thereby to generate preprocessed harmony data; and feed process steps arranged to feed the preprocessed harmony data into a main processing portion of the harmony generation RANN.

19. A computer program product according to claim 16, wherein the computer readable medium has recorded thereon a computer program further comprising storage process steps arranged to store results of a plurality of prior outputs from each respective RANN within the state units associated therewith.

20. A system for automatically generating music on the basis of an initial note sequence input, the system including:

a score interpreter for interpreting each note in the initial input sequence, thereby to generate current note pitch data, current note duration data and current note musical context data;

a rhythm production recurrent artificial neural network for generating a subsequent note duration output on the basis of the current note duration data, the current musical context data and note duration information stored in state units associated with the rhythm production recurrent artificial neural network;

a note generation recurrent artificial neural network for generating a subsequent note on the basis of the subsequent note duration output, the current note pitch data, the current note musical context data, the current note duration data, and duration and pitch information stored in state units associated with the note generation recurrent artificial neural network; and feedback means for feeding the pitch and duration of the subsequent note back to the rhythm generation and note generation recurrent artificial neural networks, the subsequent note thereby becoming the current note for a following iteration; wherein during a learning phase each of the recurrent artificial neural networks is trained by feeding the score of at least one piece of music through the score interpreter, internal weights associated with an artificial neural network portion of each of the recurrent artificial neural networks being adjusted in response to the input musical score.

21. A method for automatically generating music on the basis of an initial note sequence input, the method comprising steps of:

interpreting each note in the initial input sequence, thereby to generate current note pitch data, current note duration data and current note musical context data;

generating a subsequent note duration output on the basis of the current note duration data and the current note context data using a rhythm production recurrent artificial neural network;

storing the current musical context data and note duration information in one or more state units associated with the rhythm production recurrent artificial neural network;

generating a subsequent note using a note generation recurrent artificial neural network on the basis of the subsequent note duration output, the current note pitch data, the current note musical context data, the current note duration data, and duration and pitch information stored in state units associated with the note generation recurrent artificial neural network; and feeding back the pitch and duration of the subsequent note back to the rhythm generation and note generation recurrent artificial neural networks, the subsequent note thereby becoming the current note for a following iteration; wherein during a learning phase each of the recurrent artificial neural networks is trained by feeding the score of at least one piece of music through the score interpreter, internal weights associated with an artificial neural network portion of each of the recurrent artificial neural networks being adjusted in response to the input musical score.

22. A computer program product including a computer readable medium having recorded thereon a computer program for automatically generating music on the basis of an initial note sequence input, the computer program comprising:

interpretation process steps arranged to interpret each note in the initial input sequence, thereby generating current note pitch data, current note duration data, and current note musical context data;

generating process steps arranged to generate a subsequent note duration output on the basis of the current note duration data and the current note context data using a rhythm production recurrent artificial neural network;

storing process steps arranged to store the current musical context data and note duration information one or more state units associated with the rhythm production recurrent artificial neural network;

generation process steps arranged to generate a subsequent note using a note generation recurrent artificial neural network on the basis of the subsequent note duration output, the current note pitch data, the current note musical context data, the current note duration data, and duration and pitch information stored in state units associated with the note generation recurrent artificial neural network; and feedback process steps arranged to feed the pitch and duration of the subsequent note back to the rhythm generation and note generation recurrent artificial neural networks, the subsequent note thereby becoming the current note for a following iteration; wherein during a learning phase each of the recurrent artificial neural networks is trained by feeding the score of at least one piece of music through the score interpreter, internal weights associated with an artificial neural network portion of each of the recurrent artificial neural networks being adjusted in response to the input musical score.

* * * * *